United States Patent [19]

Smith et al.

[11] 4,228,750

[45] Oct. 21, 1980

[54] HYDROFOIL SAILBOAT WITH CONTROL TILLER

[76] Inventors: Bernard Smith, Rte. 1, Box 228A, King George, Va. 22485; Frank P. Delano, P.O. Box 17, Oldhams, Va. 22529

[21] Appl. No.: 868,920

[22] Filed: Jan. 12, 1978

[51] Int. Cl.[2] ..... B63H 9/04

[52] U.S. Cl. ..... 114/39; 114/144 R; 114/280; 114/281; 180/333; 280/771; 74/89.15

[58] Field of Search ..... 114/39, 274, 280, 281, 114/144 R, 162; 74/89.15; 180/77 H; 280/771

[56] References Cited

U.S. PATENT DOCUMENTS

| | | | |
|---|---|---|---|
| 3,094,961 | 6/1963 | Smith | 114/39 X |
| 3,173,395 | 3/1965 | Laurent | 114/39 |
| 3,870,004 | 3/1975 | Bailey | 114/39 |
| 3,981,258 | 9/1976 | Smith | 114/39 |

*Primary Examiner*—Sherman D. Basinger
*Attorney, Agent, or Firm*—Martin P. Hoffman

[57] ABSTRACT

A hydrofoil sailboat having a sailing frame that is secured by swivel connection to a conventional hull, the frame comprising a plurality of prestressed interconnected spars, guys and a sail, a pair of buoyant hydrofoils, one at each of the leeward extremities of the frame, and a single manually operable tiller situated at the hull for governing the direction of movement by articulating the hydrofoils in accordance with the point of sailing and the direction of the wind. The tiller is operatively associated with the hydrofoils through pairs of spreaders and multiple cables. The sail is inclined to the vertical axis, and is tightly stretched to define an air foil spaced laterally away from the hull. The crank adjusts the inclination of sail and the hydrofoils cancel out listing moments. The sail frame exerts a towing force on the hull.

14 Claims, 8 Drawing Figures

FIG. 1.
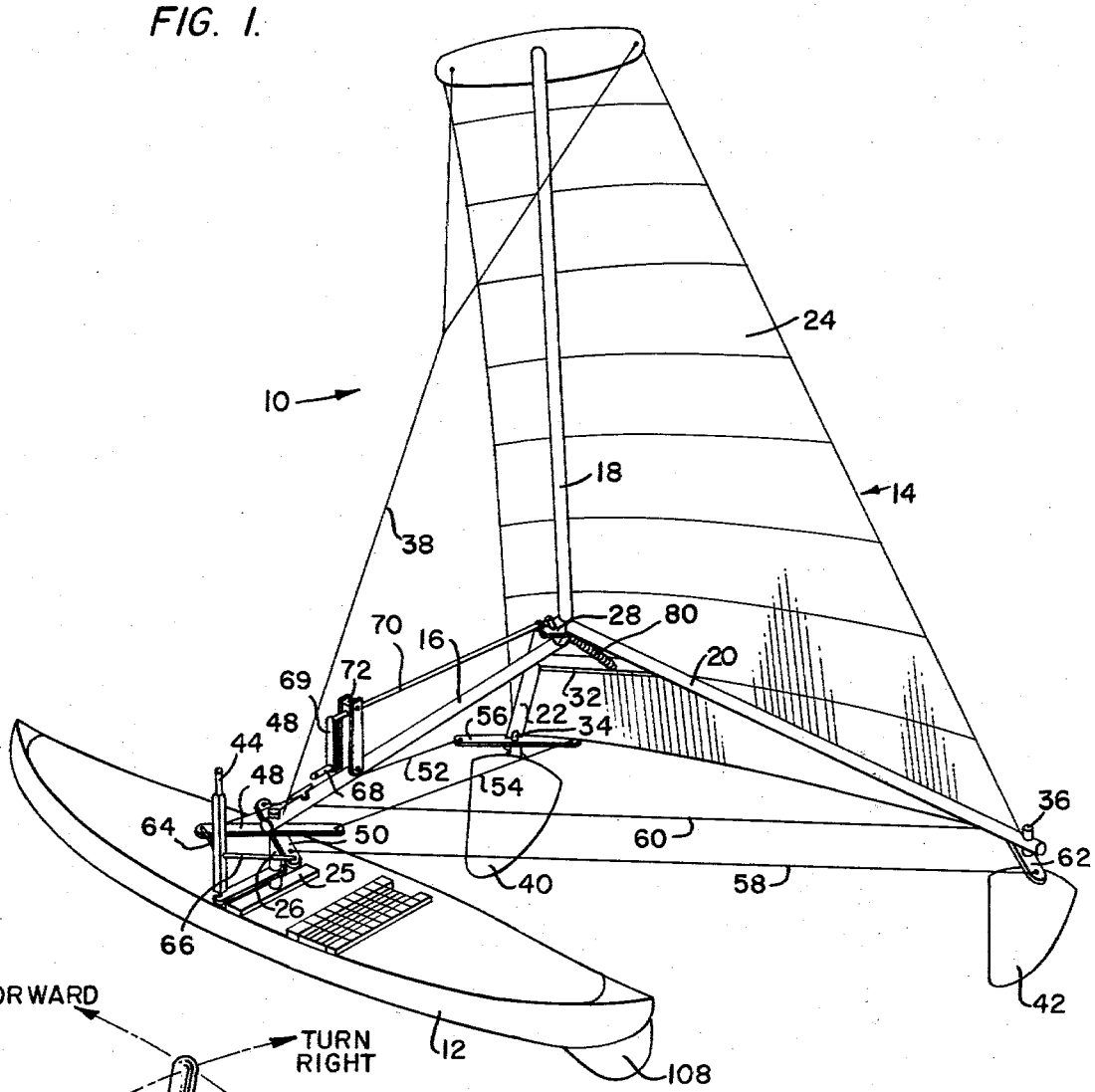
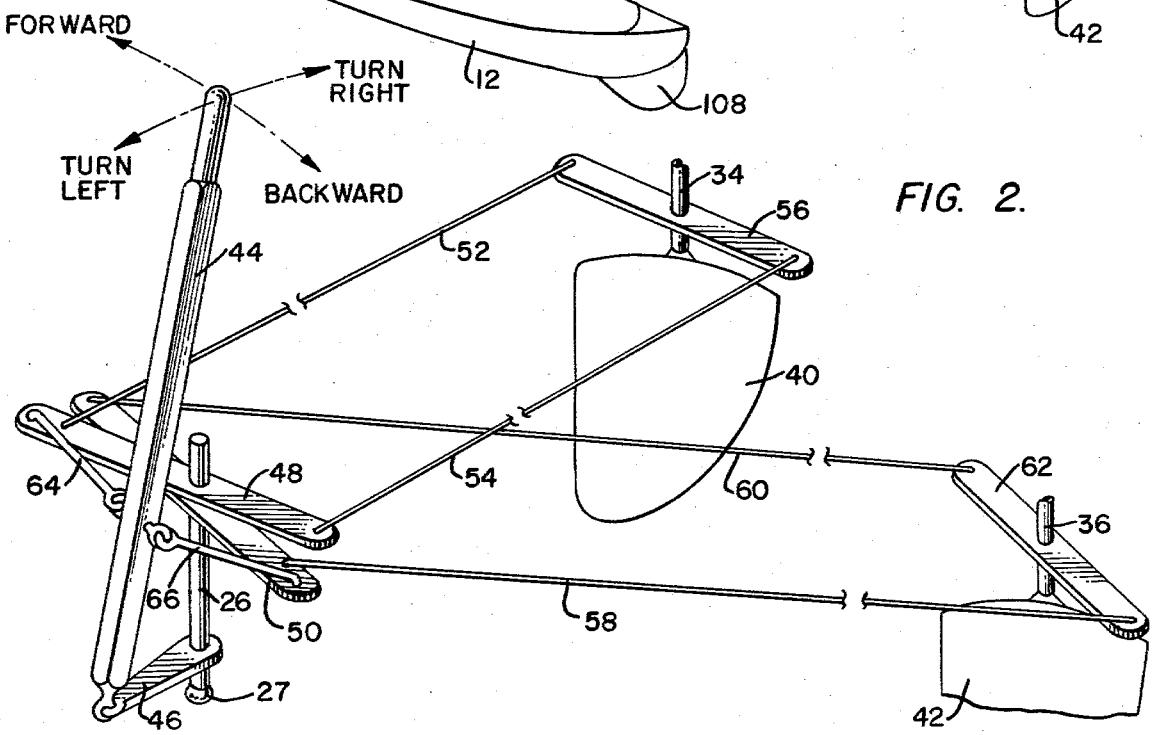
FIG. 2.

HYDROFOIL SAILBOAT WITH CONTROL TILLER

BACKGROUND OF THE INVENTION

1. Field of the Invention

The instant invention relates generally to hydrofoil sailboats and more particularly to refinements in the control tiller for adjusting the hydrofoils which steer the frame and boat, and in the mechanism for altering the inclination of the sail.

2. Prior Art

The quest for a hydrofoil saiboat capable of attaining high speed even in low winds, wih a shallow draft, and reasonably high payloads has been long lived. One of the milestones in this arduous quest has been a book entitled "The 40-Knot Sailboat" written in 1963 by one of the present applicants and published by Grosset and Dunlop, New York, N.Y. To date, although several attempts have been made by the present applicants and numerous other skilled inventors to achieve all of these desirable operational characteristics, no single sailboat has been designed and/or built that has satisfied these criteria.

The evolutionary steps made toward realizing the abovenoted optimum operational characteristics are shown in U.S. Pat. No. 3,094,961, issued Jan. 25, 1963, U.S. Pat. No. 3,295,487, issued Jan. 3, 1967, U.S. Pat. No. 3,631,828, issed Jan. 4, 1972, U.S. Pat. No. 3,646,902, issued Mar. 7, 1972 and in U.S. Pat. No. 3,981,258, issued Sept. 21, 1976. All of these patents were awarded to Bernard Smith, one of the present applicants. The cited patents provide a discussion of the structure, dynamic forces and controls the one particular variety of hydrofoil sailing frames. Although each of the aerohydrofoils and hydrofoil sailboats disclosed possessed certain desirable features, all suffered from one or more deficiencies that limited their commercial acceptance.

For example, the hydrofoil sailboat disclosed in U.S. Pat. No. 3,981,258 employs a slender hull with one flat side facing the foil shaped sail and one convex side facing away from the sail. The sail is supported at its base ends by a pair of freely swiveling waterskis, and a ruddering hydrofoil is disposed at each end of the specially shaped hull. A crank is adjusted to take up, or release, the cables that position the ruddering hydrofoils, and the sail is inclined from the vertical to eliminate listing moments.

The hydrofoil sailboats patented by Smith prior to the sailboat shown in U.S. Pat. No. 3,981,258 suffered from one or more of the following defects: sorely limited load carrying capacity, unsatisfactory performance in low wind and inordinate draft, making such craft unsuitable for shallow water or beaching operations. Although the waterski sailboat disclosed in U.S. Pat. No. 3,981,258 solved most of the problems encountered with the hydrofoil sailboats disclosed in the eariler Smith patents, its control system (best shown in FIG. 4) proved too cumbersome in strong winds, requiring excessive manual force and dexterity. Moreover, the hydrofoils attached to the bow and stern of the hull of the waterski sailboat could not be conveniently inclined to supply additional lift at high speed.

SUMMARY

Thus, with the deficiencies of the previously known aerohydrofoils and hydrofoil sailboats clearly in mind, the instant invention contemplates a hydrofoil sailboat employing a unique sailing frame pivotally secured to a conventional hull. The sailing frame includes a sail tilted from the vertical and and towards the hull, and a framework of spars for laterally spacing the sail from the hull. The sail is supported at each leeward end by a hydrofoil. A single tiller is situated at the hull for operating parallelograms of spreaders and cables to simultaneously adjust the hydrofoils, and easily steers the boat. The use of a hull not especially designed to sailing is feasible because the listing forces normally imposed upon sailboats are cancelled out by counterbalancing moments.

The instant hydrofoil sailboat further contemplates a crank-operated lead screw mechanism for adjusting the inclination of the sail relative to the vertical.

Additionally, the instant hydrofoil sailboat utilizes a plurality of prestressed spars that interconnect the sail and both of the hydrofoils; the spars incline the hydrofoils in an opposite sense to the sail thus cancelling the listing moments that would otherwise be produced.

Also, in one embodiment, the sailing frame is joined to the hull by a swivel connection that allows motion in the horizontal plane, but precludes motion in the vertical plane. The hull may thus be free to pitch and yaw without adversely influencing the sailing frame. In an alternative embodiment, the sailing frame may be employed to stabilize the hull against roll without constraining other motions of the hull and the frame.

Furthermore, the hull of the sailboat may be a canoe, kayak, or rowing hull, so that the sailing frame may be sold as an after-market, additional accessory kit for quickly converting a conventional hull into a safe, stable, high performance sailboat. Alternatively, the sailing frame and hull may be sold, in assembled condition, as a unique hydrofoil sailboat.

The components of the sailing frame define a tetrahedron; the spars are prestressed in compression and such forces are pitted against the tensile forces exerted by other components. The equilibrium of these forces leads to a rigid, but durable, sailing frame.

Other objects, advantages and desirable attributes of the instant hydrofoil sailboat will become readily apparent from the following detailed description of the invention when construed in harmony with the accompanying drawings.

BRIEF DESCRIPTION OF THE DRAWINGS

FIG. 1 is a perspective view of the hydrofoil sailboat constructed in accordance with the principles of this invention;

FIG. 2 is a fragmentary perspective view of the tiller and related mechanism for controlling the pair of hydrofoils employed by the hydrofoil sailboat;

DETAILED DESCRIPTION OF THE PREFERRED EMBODIMENT

Figure 3:
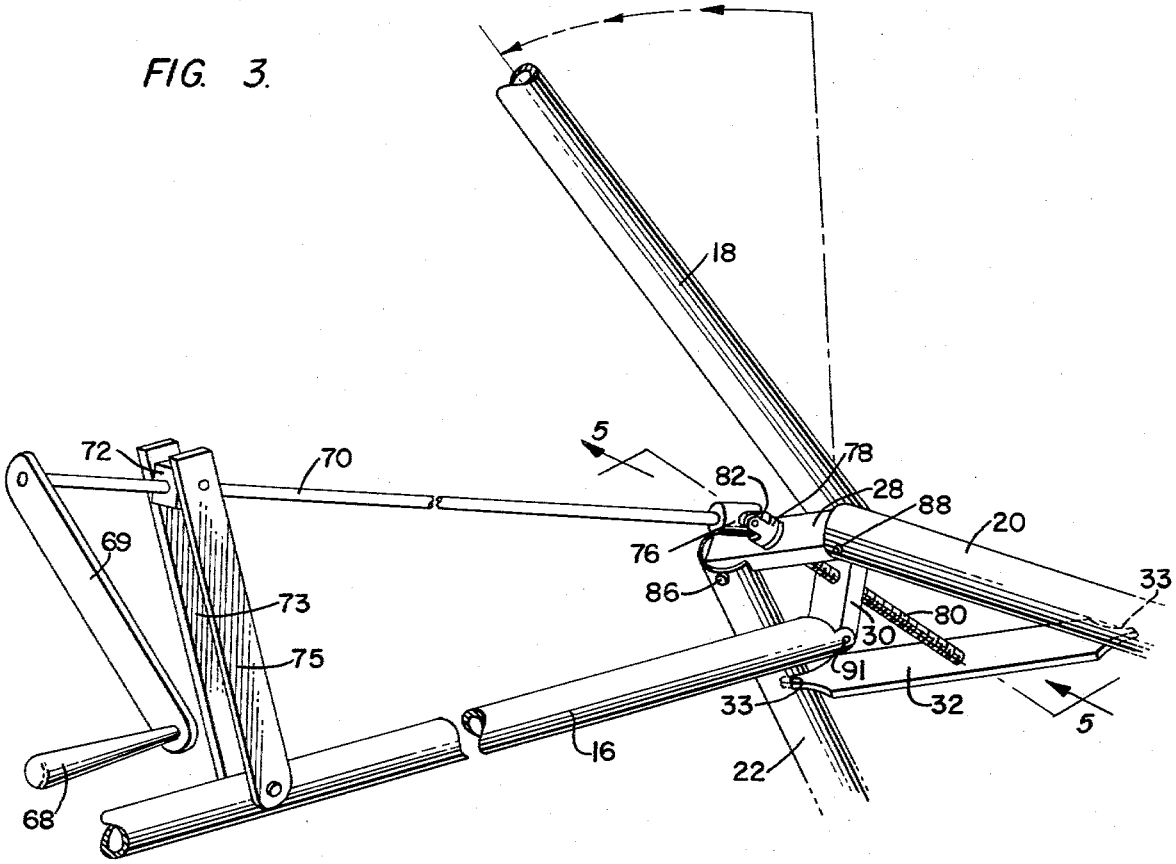
FIG. 3 is a fragmentary perspective view, on an enlarged scale, of the crank and lead-screw mechanism for adjusting the inclination of the sail.

FIG. 1 shows a hydrofoil sailboat constructed in accordance with the principles of the instant invention, such sailboat 10 including a conventional hull 12 with a unique sailing frame 14 pivotally secured thereto. The sailing frame includes, inter alia, a framework of four spars 16, 18, 20 and 22 and a sail 24. The spars may be fabricated from aluminum tubing to reduce their weight and facilitate their handling.

A brace 25 is secured to the hull 12, and a standard 26 extends vertically above the gunwhales of the hull 10. A hole is formed near one end of the spar 16 to receive the standard. Standard 26 extends through brace 25 and its lower end is received in a ball joint 27 (better shown in FIG. 2). The standard can thus rotate 360° relative to the brace 25 and the hull 12. The spar 16 is maintained in a fixed inclination to the horizontal at all times, and field tests have indicated that only 90° of pivotal motion by the spar will enable the boat to be sailed in any direction.

The spar 18 extends vertically to support the sail 24, and a block 28 (better shown in FIG. 3) joins the spars 16 and 18. A second block 30 joins the spars 20 and 22 together for joint movement, and a crossbar 32 maintains the appropriate spacing between the spars 20, 22. The opposing, tapered ends of the crossbar 32 fits into apertures 33 in spars 20 and 24. A shaft 34 is journaled upon the opposite end of spar 22, and a shaft 36 is similarly journaled upon the opposite end of spar 20. A guy-line 38 is stretched taut between the upper end of the sail 24 and the spar 16 so that the framework of spars is always under compressive loading.

The sail 24 is always stretched taut and serves as an air foil to propel the frame and tow the hull and its contents. The sail may be made of four-ounce dacron or other suitable durable, light-weight materials. A pair of hydrofoils 40, 42, one situated at each leeward end of the sail, support the sail at its corners. Hydrofoil 40 is secured to shaft 34, while hydrofoil 42 is secured to shaft 36.

FIG. 2 shows the details of the steering mechanism. A single tiller 44 is joined to standard 26 by a link 46 that extends parallel to the brace 25. The single tiller 44 is joined pivotally to the link 46 that extends from standard 26. The link 46 is keyed or otherwise secured to the standard. A first control spreader 48 and a second control spreader 50 are positioned along the axial extent of standard 26. The first control spreader 48 is joined by cables 52, 54 to a first hydrofoil spreader 56 fixedly secured to shaft 34. The second control spreader 50 is similarly joined by cables 58, 60 to a second hydrofoil spreader 62 fixedly secured to shaft 36. A first link 64 joins the tiller 44 to one end of control spreader 48, and a second link 66 joins the tiller 44 to one end of control spreader 50.

The cables 52, 54, the control spreader 48 and the hydrofoil spreader 56 define a parallelogram, and the adjustment of control spreader 48 immediately results in a similar adjustment at hydrofoil spreader 56 and the hydrofoil situated therebelow. The cables 58, 60, the control spreader 50 and the hydrofoil spreader 62 also define a parallelogram and function in a similar manner. Thus, by simply manipulating tiller 44, both hydrofoils are simultaneously adjusted to the selected orientation.

FIG. 3 depicts the crank operated lead screw mechanism for altering the angle of the sail 24, which functions as an air foil. The driving power of the sail, which is translated through the sailing frame 14 into the towing force acting upon the hull 12, reaches its maximum when the angle of the sail away from the vertical is minimized. When strong winds are encountered, the driving power of the sail 24 is reduced by increasing the angle of the sail relative to the vertical. In field tests, the sail is usually disposed inclined about 30° away from the vertical; however, the crank operated lead screw mechanism can pivot the sail over a 60° arc into a horizontal attitude that is perpendicular to the vertical axis of the boat. As the sail is inclined from the vertical, hydrofoils 40, 42 will, to a lesser extent, be inclined more to the vertical; thus, as the lift of the sail 24 increases, the lift of the hydrofoils is reduced, thereby keeping the resistance to listing sensibly constant under all conditions.

When the angle of inclination of the sail 24 is to be altered, one of the crew members in the hull 12 grasps the handle 68 and manually rotates the crank 69, which is secured to one end of elongated rod 70. The rod 70 passes through a guide block 72, which is fastened between upstanding arms 73, 75. The arms are joined to the spar 16. A collar 76 is secured to the remote end of the rod 70, and a similar collar 78 is secured to one end of lead screw 80. A pin 82 extends through collars 76, 78 so that the two collars are rotated in unison. The rotational movement of crank 69 and rod 70 in one direction advances the lead screw 76 through the threaded aperture of block 28 and draws the spar 18 in an arcuate path towards the vertical plane, thus reducing the relative distance between blocks 28 and 30, and increasing the angle between spars 16 and 18. Reversing motion of the lead screw 76 reduces the angle between the spars 16 and 18, and reduces the distance that must be spanned by guy-line 38 (FIG. 1).

Under extreme conditions, the sail 24 can be lowered into a horizontal, or full down orientation, to serve as a canopy, for the occupants of the hull 12. While the angle of the sail 24 is being altered, the framework of spars adjusts the hydrofoils 40, 42 in the opposite direction, but to a lesser degree, to keep listing resistance approximately constant. The spars, it should be noted, are prestressed and maintained in in compression at all times.

Figure 4:
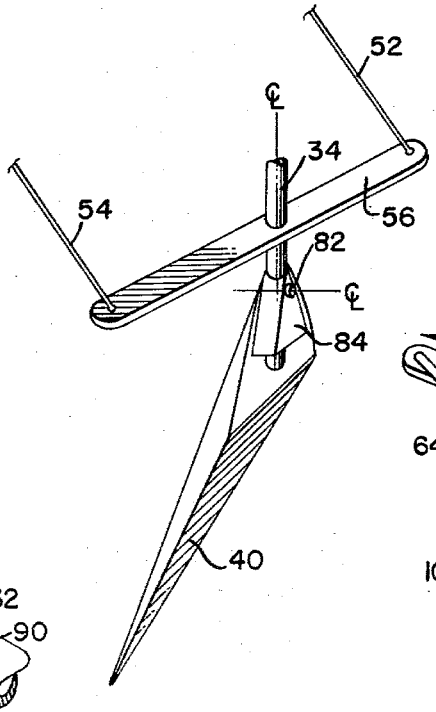
FIG. 4 is a detailed perspective view of one of the hydrofoils.

FIG. 4 shows the details of one of the pair of hydrofoils 40, 42, which function similarly. The hydrofoils serve to provide leeway resistance and ruddering in addition to providing lift at high speeds. Hydrofoil 40, as seen from the leeward side, is allowed to pivot about a vertical axis passing through shaft 34, and is allowed to pivot fore and aft about a horizontal axis passing through axle 82 which extends through a bearing 84 situated at the lower end of shaft 34. Other bearings, such as universal bearings, can be used to permit the two degrees of freedom of movement. The hydrofoils are thus capable of two degrees of freedom of movement, and, in response to hydrodynamic forces imposed thereon, can automatically adjust to bring the center of pressure of each hydrofoil in line with the turning axis to minimize resistance to turning. The tack of the sailing frame can thus be easily and speedily altered.

Figure 5:
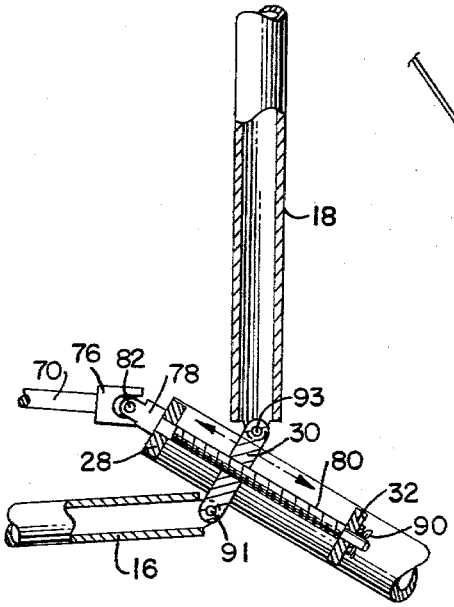
FIG. 5 is a fragmentary, vertical cross-sectional view through the mechanism for adjusting the orientation of the sail, such view being taken along line 5—5 in FIG. 3 and in the direction indicated.

FIG. 5, when viewed in harmony with FIG. 3, reveals the structural details of the mechanism for adjusting the inclination of sail 24. The movement of the block 30 relative to block 28 is indicated by the directional arrows. Also, the removable pins 86, 88 which join the block 28 to spars 20 and 22 are clearly shown in FIG. 3, and the cotter pin 90 and the washer which secure the unthreaded end of the lead screw to crossbar 32 are shown in FIG. 5. Removable pins 91, 93 join the block 30 to spars 16 and 18.

Figure 6:
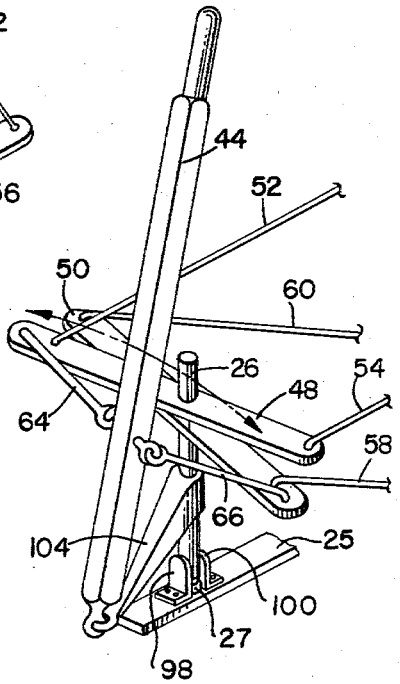
FIG. 6 is a fragmentary perspective view of an alternative embodiment of the tiller and related mechanism for controlling the pair of hydrofoils.

FIG. 6 shows an alternate tiller mounting arrangement that constrains the hull 12 in roll but permits the hull to pitch and turn. Ball joint 27 at end of standard 26 is retained and two ears 98 and 100, straddling standard 26, are added to brace 25. Since clearances are provided between standard 26 and the ears, which are aligned fore-and-aft, the hull and sailing frame can independently pitch and rotate directionally as described earlier. However, any tendency of the hull to roll is checked by contact of the ears against the sides of standard 26. Thus the hull is coupled to the sailing frame in roll and thereby partakes of far greater roll stability. To make room for ears 98 and 100, link 46 in FIG. 2 is replaced with revised link 104 in FIG. 6. Link 104 is joined to standard 26 and pivotally supports tiller 44 as described before. The links, spreaders and cables for controlling the hydrofoils remain otherwise unchanged.

Figure 7:
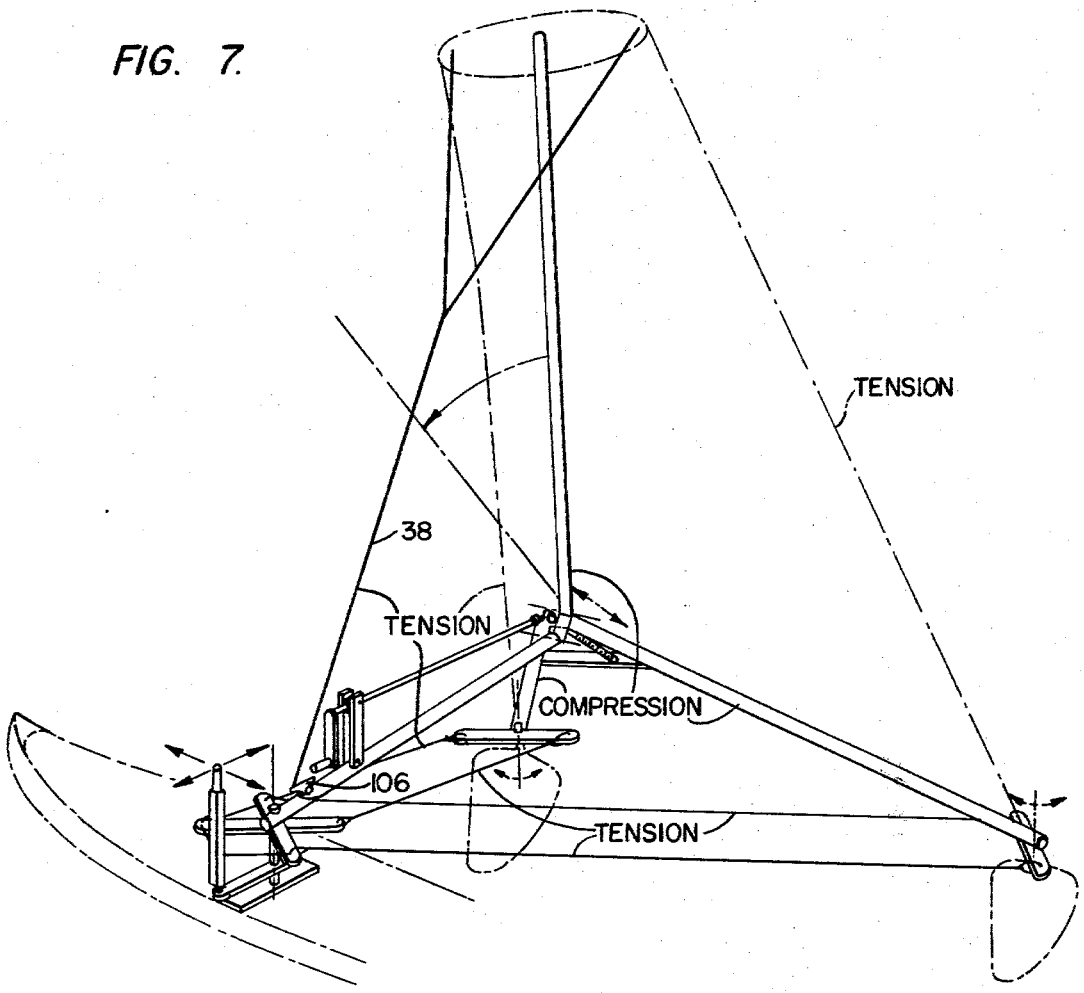
FIG. 7 is a schematic diagram illustrating the manner in which forces are distributed over the various components of the hydrofoil sailboat.

FIG. 7 reveals that the sailing frame is, in essence, a tetrahedral structure. Such tetrahedral structure is defined by the top or headboard of the sail 24, the attachment point at the hull 12, and the attachment points for hydrofoils 40, 42 to spars 20 and 22; these four points represent the four vertices of a tetrahedron. The six edges of the tetrahedron are approximated by the three edges of the sail 24, the two sets of control cables, and the guy-line 38.

The framework of spars 16, 18, 20 and 22 are prestressed, in compression, by the above-described tetrahedral structure whereas the sail, control cables and guy-line 38 are in tension. These components are prestressed either by tightening guy-line 38 against the cleat 106 on the spar 16 or by turning the crank 69 in the manner shown in FIG. 3. Under most conditions, the turning of the crank will suffice once the guy-line 38 is adjusted for "reefed" position, or full up. The compressive forces on the spars are thus pitted against the tensile forces on the sail, control cables and guy-line, and a dynamic equilibrium condition is achieved.

Figure 8:
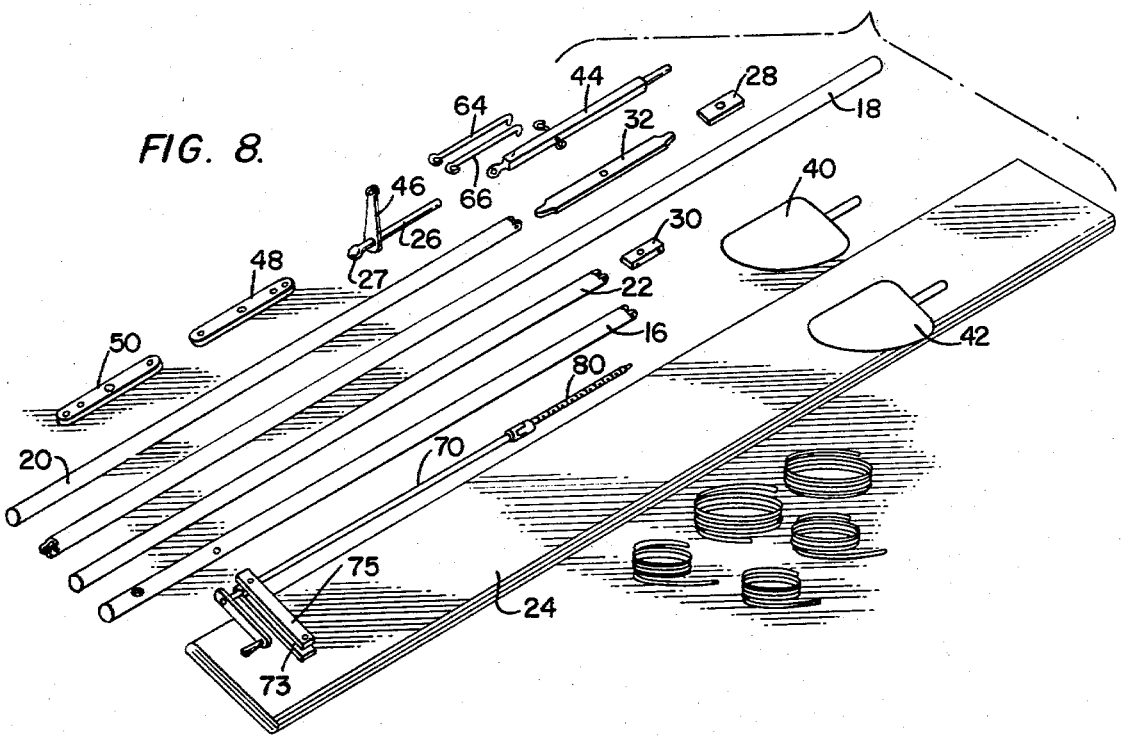
FIG. 8 is a perspective view of the various components in disassembled condition.

FIG. 8 shows the sundry components of the sailing frame 14 in disassembled condition. In order to take apart the sailing frame, the crank is backed off until the sail 24 is in a horizontal plane. The pins 86, 88 are withdrawn from the spars 20, 22 so that these spars are freed from block 28 and the crossbar 32 slips out easily from the apertures 33 in the spars. The spars 20, 22 are then brought parallel to the spars 16, 18, which have already been brought close together by the reversing action of lead screw 80. The sail headboard assembly can then be unbolted and the sail 24 can be wrapped about the entire assembly. The hydrofoils 40, 42 can also be removed from spars 20, 22. Furthermore, pins 91, 93 can be removed from spars 16 and 18 to free these members from block 28. Assuming that the sail has an area of 140 square feet, all of the disassembled components can be considered as a package 11 ft.×1 ft.×8 inches in size. Manifestly, such package represents a kit that can be sold as an add-on accessory kit for existing hulls. Alternatively, the sailing frame 14 can be sold, as an integral part of a unique hydrofoil saiboat, and can be removed therefrom, whenever desired, so that the hull can be used for other purposes.

OPERATION

The hydrofoil sailboat 10 is put in motion by moving the tiller 44 forward, or backward, from its normal, upright central position; moving the tiller 44 forward gains headway while pulling the tiller back gains sternway. Tacks are changed by shifting the tiller 44 to the opposite direction, whereupon the sailing frame 14 momentarily stops and proceeds in the opposite direction for the other tack. The same action can also be used as a brake when a hazardous condition is encountered. Points of sailing can be changed from beating to reaching by adjusting the tiller 44 forward or backward accordingly. Returning the tiller 44 in its upright, central or neutral position, stops all motion of the boat except drift. During these maneuvers, the sailing frame 14 tows the hull 12 along.

Moving tiller 44 to one side, or the other, causes the parallelograms defined by the spreaders and the cables, to turn both of the hydrofoils 40, 42 to achieve a steering motion. Thus, when the sailing frame 14 has attained forward movement, moving the tiller 44 to the right turns the sailing frame 14 to the right. This relationship is shown in FIG. 2. Similarly, when the sailing frame has attained forward movement, moving the tiller 44 to the left turns the sailing frame to the left. Other suitable control systems for operating the hydrofoils may be utilized.

ALTERNATIVE EMBODIMENTS

The hydrofoil sailboat shown in FIGS. 1–8 has admirably met the desired criteria of high speed operation in low winds, shallow draft, and greater payloads than those attained with known aerohydrofoils and hydrofoil sailboats. Additionally, the hydrofoil sailboat attains speeds equal to those of the aerohydrofoil and the water ski sail in moderate winds. Field tests have amply demonstrated the superior operating characteristics of the instant hydrofoil sailboat.

Although the hydrofoil sailboat of FIGS. 1–8 has operated admirably, many modifications, alterations, and revisions could be made by the skilled artisan without departing from the teachings and suggestions made in the specification. For example, the sailing frame 14 could be made to propel any vessel or body operating on land, ice, snow, rails, or some other suitable surface by the expedient of replacing the hydrofoils 40, 42 and/or hull 12 with skis, wheels, blades, runners or the like suitable to the surface on which the frame is intended to operate. Also, as noted previously, the tiller 44 may operate the hydrofoils 40, 42 to steer the boat through other control mechanisms, such as linkages, control rods, etc. The hull 12 may have a stabilizing fin 108 secured thereto, if the hull lacks inherent directional stability, and the swivel connection between the sailing frame and the hull may assume diverse forms. The crank operated mechanism for altering the relationship between spars 16, 18 to erect the sail 24 may utilize a lazy-tong mechanism in cooperation with the crank operated lead screw. Cross-bar 32 with tapered ends can be replaced by a length of channel iron that may be bolted in position. Accordingly, the appended claims should not be limited to their exact terms, but should be liberally construed in a manner commensurate with the scope of the advance in the hydrofoil sailboat technology realized by the instant invention.

We claim:

1. A hydrofoil sailboat comprising:

(a) a hull, (b) a sailing frame including a sail, a plurality of interconnected spars, a pair of hydrofoils, one hydrofoil supporting each lower corner of the sail, (c) means for securing one of said spars to said hull so that said sailing frame can pivot relative thereto, (d) spreader mechanisms extending between said hull and said pair of hydrofoils for adjusting and maintaining said hydrofoils in a cooperative relation, (e) each spreader mechanism including a separate control spreader situated at the hull and a hydrofoil spreader situated proximate to the hydrofoil, and control means extending between the control spreader and the hydrofoil spreader so that the movement of the control spreader controls the movement of the hydrofoil spreader, and (f) manually operable means situated at the hull for simultaneously moving said spreader mechanisms to alter the position of both of said hydrofoils for steering said sail frame so that said sail frame tows said hull therebehind.

2. The hydrofoil sailboat as defined in claim 1 wherein said manually operable means comprises a tiller and a pair of identical spreader mechanisms are controlled by the movement of said tiller.

3. The hydrofoil spreader as defined in claim 2 wherein a link connects the tiller to both of the control spreaders so that sidewards movement of the tiller alters the position of the control spreaders.

4. The hydrofoil spreader as defined in claim 2 wherein a brace extends across the interior of the hull and a standard extends vertically upwardly therefrom, and a link connects the standard and the lower end of the tiller, the tiller being capable of forward, backward, and sideward movement relative to the standard.

5. The hydrofoil spreader as defined in claim 4 wherein a ball joint receives the lower end of the standard.

6. The hydrofoil spreader as defined in claim 4 wherein a pair of laterally spaced ears extend upwardly from said brace and the lower end of said standard is positioned therebetween, the tendency of said hull to roll being checked by the contact of said standard with either of said ears.

7. The hydrofoil spreader as defined in claim 6 wherein said standard and said ears on the brace are aligned fore-and-aft.

8. The hydrofoil sailboat as defined in claim 1 wherein said sail, when fully raised, is tilted at an angle of 30° to the vertical and said hydrofoils are tilted at approximately the same angle but in the opposite sense.

9. The hydrofoil sailboat as defined in claim 8 further including manually operable means for altering the tilt of the sail from 30° to 90° relative to the vertical, said sail serving as a canopy for the hull when tilted at a right angle to the vertical.

10. The hydrofoil sailboat as defined in claim 9 wherein said manually operable means includes a crank, an elongated rod rotated by said crank, a lead-screw secured to the opposite end of said rod, and bearing blocks with threaded apertures to allow the lead-screw to advance relative thereto and alter the tilt of said sail.

11. The hydrofoil sailboat as defined in claim 10 wherein at least one of the bearing blocks is secured by removable pins to said spars.

12. The hydrofoil sailboat as defined in claim 11 wherein said pins can be removed from said bearing block to free the spars, the spars then being disassembled.

13. The hydrofoil sailboat as defined in claim 1 wherein each hydrofoil is mounted for movement about a vertical axis and for fore-and-aft movement about a horizontal axis, the compound movement of the hydrofoils shifting the center of pressure upon the hydrofoils into alignment with their turning axes.

14. A method of steering a hydrofoil sailboat comprising a hull, a sailing frame including a sail, a plurality of interconnected spars, a pair of hydrofoils, one hydrofoil supporting each lower corner of the sail, spreader mechanisms extending between the hull and the pair of hydrofoils, each spreader mechanism including a control spreader and a hydrofoil spreader, with cables extending therebetween, and manually operable control means situated at the hull, said method comprising the steps of:

(a) securing one of the spars to the hull so that the hull can pivot relative thereto and trail behind the sailing frame, (b) positioning the control spreader at the hull and the hydrofoil spreader proximate to the hydrofoil so that the cables and the spreaders define a parallelogram, (c) manipulating the control means to simultaneously actuate the spreader mchanisms to alter the position of the hydrofoils and maintain same in a cooperating manner, thereby (d) steering the sailing frame to catch the wind and two the hull therealong.

* * * * *